US011521559B2

(12) United States Patent
Bai et al.

(10) Patent No.: US 11,521,559 B2
(45) Date of Patent: Dec. 6, 2022

(54) DISPLAY PANEL HAVING A SWITCH UNIT BETWEEN A DIGITAL-TO-ANALOG CONVERTER AND AN AMPLIFIER FOR IMPROVING DRIVING AND DRIVING METHOD THEREOF

(71) Applicant: BOE TECHNOLOGY GROUP CO., LTD., Beijing (CN)

(72) Inventors: Xiao Bai, Beijing (CN); Shengji Yang, Beijing (CN); Pengcheng Lu, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/258,892

(22) PCT Filed: Mar. 27, 2020

(86) PCT No.: PCT/CN2020/081883
§ 371 (c)(1),
(2) Date: Jan. 8, 2021

(87) PCT Pub. No.: WO2021/189497
PCT Pub. Date: Sep. 30, 2021

(65) Prior Publication Data
US 2022/0139329 A1 May 5, 2022

(51) Int. Cl.
*G09G 3/3275* (2016.01)

(52) U.S. Cl.
CPC ... *G09G 3/3275* (2013.01); *G09G 2300/0426* (2013.01); *G09G 2300/0828* (2013.01); *G09G 2310/0291* (2013.01)

(58) Field of Classification Search
CPC ..... G09G 3/3275
(Continued)

(56) References Cited

U.S. PATENT DOCUMENTS 9,099,026 B2 8/2015 Shiibayashi et al.
9,406,279 B2 8/2016 Shiibayashi et al.
(Continued)

FOREIGN PATENT DOCUMENTS

CN 105047137 A 11/2015
CN 107146586 A 9/2017
(Continued)

OTHER PUBLICATIONS

Written Opinion for International Application No. PCT/CN2020/081883 dated Dec. 23, 2020.

*Primary Examiner* — Long D Pham
(74) *Attorney, Agent, or Firm* — Perilla Knox & Hildebrandt LLP; Kenneth A. Knox

(57) ABSTRACT

The present disclosure relates to a display panel and a driving method thereof. The display panel includes a source driving circuit and a pixel driving circuit. The source driving circuit includes a DAC power amplifier, and a switch unit. The DAC is configured to convert a digital data signal into an analog data signal; the power amplifier is configured to receive the analog data signal and improve a driving capability of the analog data signal; the switch unit is connected to the DAC, the power amplifier, and a control signal terminal, and is configured to connect the DAC to the power amplifier in response to a signal of the control signal terminal. The pixel driving circuit includes a data signal terminal; an output terminal of the power amplifier is connected to the data signal terminal, and is configured to input the analog data signal with improved driving capability to the data signal terminal.

19 Claims, 8 Drawing Sheets

(58) Field of Classification Search
USPC ..... 345/204
See application file for complete search history.

(56) References Cited

U.S. PATENT DOCUMENTS

| | | | | |
|---|---|---|---|---|
| 9,570,011 | B2 | 2/2017 | Shiibayashi et al. | |
| 9,793,916 | B2 | 10/2017 | Kim | |
| 9,940,878 | B2 | 4/2018 | Liang | |
| 9,985,643 | B2 | 5/2018 | Kim | |
| 9,991,903 | B2 | 6/2018 | Kim | |
| 10,199,000 | B2 | 2/2019 | Shiibayashi et al. | |
| 2006/0103619 | A1 | 5/2006 | Kim | |
| 2007/0024542 | A1* | 2/2007 | Chung | G09G 3/3291 345/76 |
| 2013/0241910 | A1* | 9/2013 | Huang | G09G 3/3696 345/87 |
| 2014/0085349 | A1 | 3/2014 | Shiibayashi et al. | |
| 2015/0287388 | A1 | 10/2015 | Shiibayashi et al. | |
| 2016/0307516 | A1 | 10/2016 | Shiibayashi et al. | |
| 2017/0110067 | A1 | 4/2017 | Shiibayashi et al. | |
| 2017/0162125 | A1 | 6/2017 | Liang | |
| 2017/0272093 | A1 | 9/2017 | Kim | |
| 2018/0006660 | A1 | 1/2018 | Kim | |
| 2018/0013444 | A1 | 1/2018 | Kim | |
| 2019/0206972 | A1* | 7/2019 | Park | H01L 27/3272 |
| 2019/0251905 | A1* | 8/2019 | Yang | G09G 3/3258 |
| 2020/0219962 | A1* | 7/2020 | Park | H01L 27/3276 |

FOREIGN PATENT DOCUMENTS

| | | | |
|---|---|---|---|
| CN | 107222197 | A | 9/2017 |
| GB | 2556799 | A | 6/2018 |
| JP | 2006072289 | A | 3/2006 |
| WO | 2018233158 | A1 | 12/2018 |

* cited by examiner

DISPLAY PANEL HAVING A SWITCH UNIT BETWEEN A DIGITAL-TO-ANALOG CONVERTER AND AN AMPLIFIER FOR IMPROVING DRIVING AND DRIVING METHOD THEREOF

CROSS-REFERENCE TO RELATED APPLICATION

The present application is a national phase application under 35 U.S.C. § 371 of International Patent Application No. PCT/CN2020/081883 filed on Mar. 27, 2020, where the contents of which are hereby incorporated by reference in its entirety herein.

TECHNICAL FIELD

The present disclosure relates to the field of display technologies and, in particular, to a display panel and a driving method thereof.

BACKGROUND

In a display panel, a source driving circuit is generally used for supplying data signals to pixel units to drive the pixel units to emit light. In the related art, when a display panel performs progressive scanning, the source driving circuit needs to output a corresponding data signal for each pixel unit. Therefore, in the related art, power consumption of the source driving circuit is relatively high.

It should be noted that the information disclosed in the Background section above is only for enhancing the understanding of the background of the present disclosure, and thus may include information that does not constitute prior art known to those of ordinary skill in the art.

SUMMARY

According to an aspect of the present disclosure, there is provided a display panel, including: a source driving circuit and a pixel driving circuit; the source driving circuit includes a digital-to-analog converter, a power amplifier, and a switch unit. The digital-to-analog converter is configured to convert a digital data signal into an analog data signal; the power amplifier is configured to receive the analog data signal and improve a driving capability of the analog data signal; the switch unit is connected to the digital-to-analog converter, the power amplifier and a control signal terminal, and is configured to connect the digital-to-analog converter and the power amplifier in response to a signal of the control signal terminal; the pixel driving circuit includes a data writing transistor, a driving transistor, a light-emitting unit, a capacitor, and a gate of the data writing transistor is connected to a control terminal; a first electrode of the data writing transistor is connected to a data signal terminal, a second electrode of the data writing transistor is connected to a first node; the driving transistor includes an active layer, and the active layer is located inside a base substrate; a control terminal of the driving transistor is connected to the first node, and a first electrode of the driving transistor is connected to a second node; the light-emitting unit is connected between the second electrode of the driving transistor and a second power terminal; the capacitor is connected to the first node; where an output terminal of the power amplifier is connected to the data signal terminal, and is configured to input the analog data signal with improved driving capability to the data signal terminal.

In an exemplary embodiment of the present disclosure, the control terminal of the data writing transistor includes a first control terminal and a second control terminal, and the data writing transistor includes a first P-type transistor and a second N-type transistor. A control terminal of the first P-type transistor is connected to the second control terminal, a first terminal of the first P-type transistor is connected to the data signal terminal, and a second terminal of the first P-type transistor is connected to the first node; a control terminal of the second N-type transistor is connected to the first control terminal, a first terminal of the second N-type transistor is connected to the data signal terminal, and a second terminal of the second N-type transistor is connected to the first node.

In an exemplary embodiment of the present disclosure, the switch unit includes: a switching transistor, a first terminal of the switching transistor is connected to the digital-to-analog converter, a second terminal of the switching transistor is connected to the power amplifier, and a control terminal of the switching transistor is connected to the control signal terminal.

In an exemplary embodiment of the present disclosure, the display panel further includes a clock control circuit, the clock control circuit includes an output terminal for outputting a pulse signal of a first frequency, and the display panel further includes a frequency converter, and the frequency converter is connected to the output terminal of the clock control circuit and the control signal terminal, and is configured to send a pulse signal of a second frequency to the control signal terminal according to the pulse signal of the first frequency.

In an exemplary embodiment of the present disclosure, the source driving circuit includes a plurality of digital-to-analog converters, a plurality of power amplifiers, and a plurality of switch units, and the plurality of digital-to-analog converters, the plurality of power amplifiers and the plurality of switch units are disposed in a one-to-one correspondence.

In an exemplary embodiment of the present disclosure, the plurality of switch units are connected to the same control signal terminal.

In an exemplary embodiment of the present disclosure, at least part of the switch units are connected to different control signal terminals.

In an exemplary embodiment of the present disclosure, the switching transistor is a P-type transistor or an N-type transistor.

In an exemplary embodiment of the present disclosure, the display panel is a silicon-based OLED display panel.

In an exemplary embodiment of the present disclosure, the silicon-based OLED display panel includes: a display area, a dummy area, and a driving circuit integration area; the display area is integrated with data lines, the dummy area is located around the display area, and the driving circuit integration area is located on a side of the dummy area away from the display area and located on a side of the display area along an extending direction of the data line, and is configured to integrate the source driving circuit.

According to an aspect of the present disclosure, there is provided a display panel driving method, used for driving the above-mentioned display panel, where the driving method includes:

inputting pulse signals of different frequencies to at least one control signal terminal in different driving modes, where each effective pulse period of the pulse signal is in a data signal writing period of a row of pixel units.

In an exemplary embodiment of the present disclosure, at least part of the switch units are connected to different control signal terminals, and in the same driving mode, the pulse signals of the different control signal terminals have the same frequency.

In an exemplary embodiment of the present disclosure, at least part of the switch units are connected to different control signal terminals, and in the same driving mode, the pulse signals of the different control signal terminals have different frequencies.

In an exemplary embodiment of the present disclosure, the driving method includes:

inputting a first pulse signal to the at least one control signal terminal in a first driving mode, where the first pulse signal outputs one effective pulse during a data writing period of each row of pixel units;

inputting a second pulse signal to the same control signal terminal, which is input with the first pulse signal in the first driving mode, in a second driving mode, where the second pulse signal outputs one effective pulse during a data writing period of every n rows of pixel units, where n is a positive integer greater than 1.

In an exemplary embodiment of the present disclosure, a first effective pulse period of the pulse signal is in a data signal writing period of the first row of pixel units.

It should be noted that the above general description and the following detailed description are merely exemplary and explanatory and should not be construed as limiting of the disclosure.

BRIEF DESCRIPTION OF THE DRAWINGS

The accompanying drawings, which are incorporated in the specification and constitute a part of the specification, show exemplary embodiments of the present disclosure. The drawings along with the specification explain the principles of the present disclosure. It is apparent that the drawings in the following description show only some of the embodiments of the present disclosure, and other drawings may be obtained from the drawings described herein by those skilled in the art without paying inventive labor.

DETAILED DESCRIPTION

Figure 1:
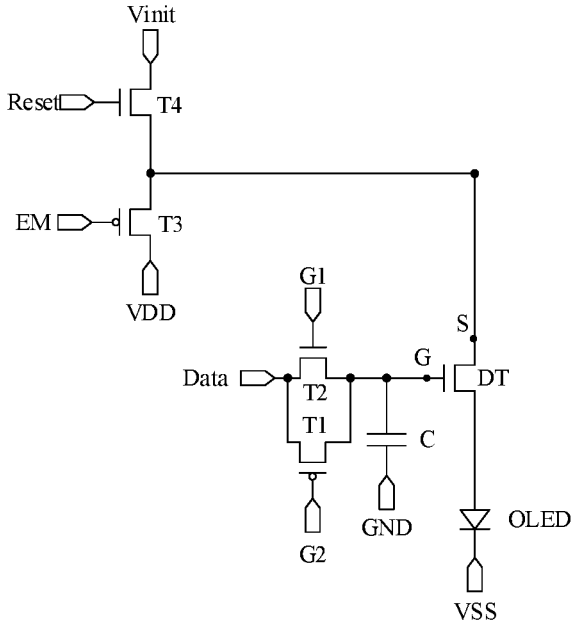
FIG. 1 is a schematic structural diagram of a pixel driving circuit of the present disclosure.

Example embodiments will now be described more fully with reference to the accompanying drawings. However, the embodiments can be implemented in a variety of forms and should not be construed as being limited to the examples set forth herein; rather, these embodiments are provided so that the present disclosure will be more complete so as to convey the idea of the exemplary embodiments to those skilled in this art. The described features, structures, or characteristics may be combined in any suitable manner in one or more embodiments. In the following description, many specific details are provided to give a full understanding of the embodiments of the present disclosure. However, those skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring various aspects of the present disclosure.

In addition, the drawings are merely schematic representations of the present disclosure and are not necessarily drawn to scale. The same reference numerals in the drawings denote the same or similar parts, and the repeated description thereof will be omitted. Some of the block diagrams shown in the figures are functional entities and do not necessarily correspond to physically or logically separate entities. These functional entities may be implemented in software, or implemented in one or more hardware modules or integrated circuits, or implemented in different networks and/or processor devices and/or microcontroller devices.

The terms "one", "a", "the" and "said" are used to indicate that there are one or more elements/components or the like; the terms "include" and "have" are used to indicate an open meaning of including and means that there may be additional elements/components/etc. in addition to the listed elements/components/etc.; the terms "first" and "second" etc. are used only as markers, and do not limit the number of objects.

Figure 2:
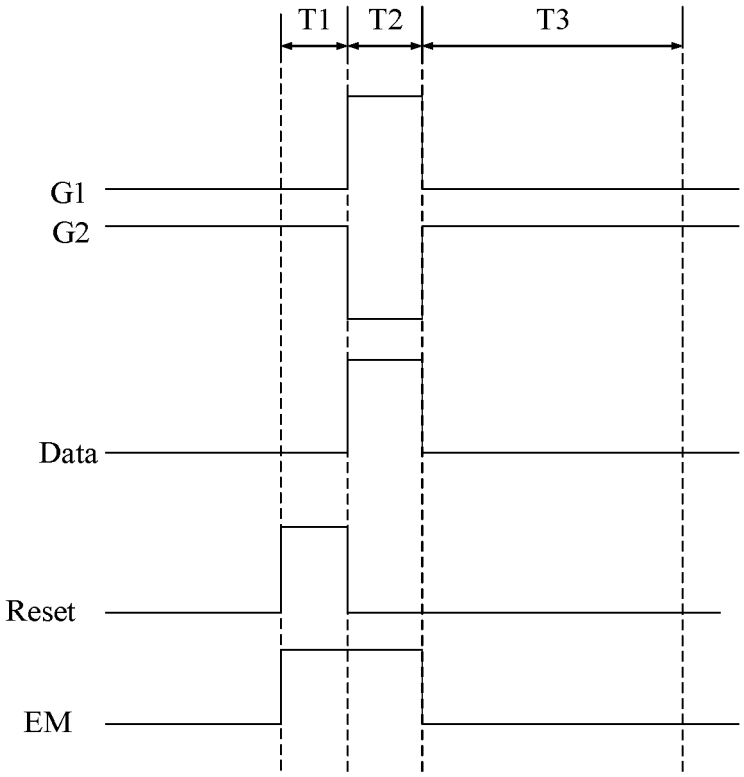
FIG. 2 is a timing diagram of various nodes in an exemplary implementation of the pixel driving circuit in FIG. 1.

FIG. 1 is a schematic structural diagram of a pixel driving circuit of the present disclosure, and FIG. 2 is a timing diagram of some nodes in an exemplary implementation of the pixel driving circuit in FIG. 1. As shown in FIGS. 1 and 2, the pixel driving circuit may include a first P-type transistor T1, a second N-type transistor T2, a driving transistor DT, a third P-type transistor T3, a fourth N-type transistor T4, a capacitor C, and a light-emitting unit OLED. A control terminal of the first P-type transistor T1 is connected to a second control terminal G2, a first terminal of the first P-type transistor T1 is connected to a data signal terminal Data, and a second terminal of the first P-type transistor T1 is connected to a first node G. A control terminal of the second N-type transistor T2 is connected to a first control terminal G1, a first terminal of the second N-type transistor T2 is connected to the data signal terminal Data, and a second terminal of the second N-type transistor T2 is connected to the first node G. A control terminal of the third P-type transistor T3 is connected to an enable signal terminal EM, a first terminal of the third P-type transistor T3 is connected to a second node S, and a second terminal of the third P-type transistor T3 is connected to a first power supply VDD. A control terminal of the fourth N-type transistor T4 is connected to a reset signal terminal Reset, a first terminal of the fourth N-type transistor T4 is connected to an initialization signal terminal Vinit, and a second terminal of the fourth N-type transistor T4 is connected to the second node S. The driving transistor DT includes an active layer located inside the base substrate; a control terminal of the driving transistor is connected to the first node G, and a first electrode of the driving transistor is connected to the second node S. The light-emitting unit OLED is connected between a second power supply terminal VSS and the second electrode of the driving transistor DT. The capacitor C is connected between a ground terminal GND and the first node G. A driving method for the pixel driving circuit includes: a reset stage, a data writing stage, and a light emitting stage. As shown in FIG. 2, in the reset stage T1, the reset signal terminal Reset is at a high level, the fourth N-type transistor T4 is turned on under the action of the high level of the reset signal terminal Reset, so that the initialization signal terminal Vinit resets the second node S. In the data writing stage T2, the data signal terminal Data is at a high level, the first control terminal G1 is at a high level, the second control terminal G2 is at a low level, and the enable signal terminal EM is at a high level, the third P-type transistor T3 is turned off under the action of the high level of the enable signal terminal EM, the first P-type transistor T1 is turned on under the action of the low level of the second control terminal G2, and the second N-type transistor T2 is turned on under the action of the high level of the first control terminal G1, so that the high-level signal of the data signal terminal Data is transmitted to the first node G and is stored it in the capacitor C. In the light-emitting stage T3, the enable signal terminal EM is at a low-level, the third P-type transistor T3 is turned on under the action of the low level of the enable signal terminal EM, so that the light-emitting unit OLED emits light.

Figure 3:
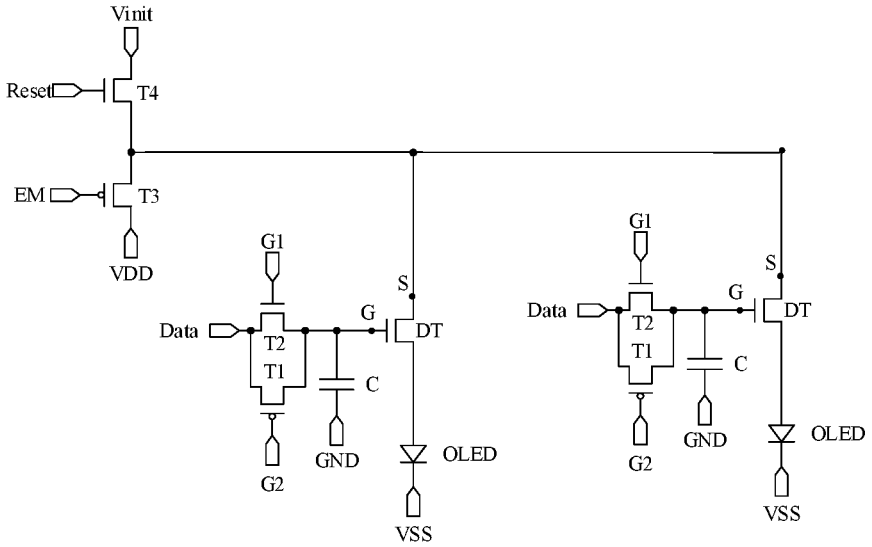
FIG. 3 is a schematic structural diagram of another pixel driving circuit of the present disclosure.

FIG. 3 is a schematic structural diagram of another pixel driving circuit of the present disclosure, and as shown in FIG. 3, a plurality of pixel driving circuits can share the same third P-type transistors T3 and fourth N-type transistors T4, that is, the first terminals of the driving transistors DT in the plurality of pixel driving circuits are connected to the same second node S. The third P-type transistor T3 and the fourth N-type transistor T4 shared by the plurality of pixel driving circuits can be disposed outside a display area of the display panel. The first P-type transistors T1, the second N-type transistors T2 and the driving transistors DT, the capacitors C, and the light-emitting units OLED can be disposed in the display area of the display panel. The third P-type transistor T3 and the fourth N-type transistor T4 in the pixel driving circuit can also be replaced with other structures to input signals of the same timing to the second node. In this exemplary embodiment, the first P-type transistor T1 and the second N-type transistor T2 are controlled to selectively connect the first node to the data signal terminal. In other exemplary embodiments, the first P-type transistor T1 and the second N-type transistor T2 can be replaced with a data writing transistor, and a gate of the data writing transistor is connected to the control terminal, a first electrode of the data writing transistor is connected to the data signal terminal, and a second of the data writing transistor is connected to the first node. The capacitor C is configured to store charges of the first node. Therefore, the capacitor C can also be connected between the first node and other nodes. For example, the capacitor C may be connected between the second power supply terminal VSS and the first node.

Figure 4:
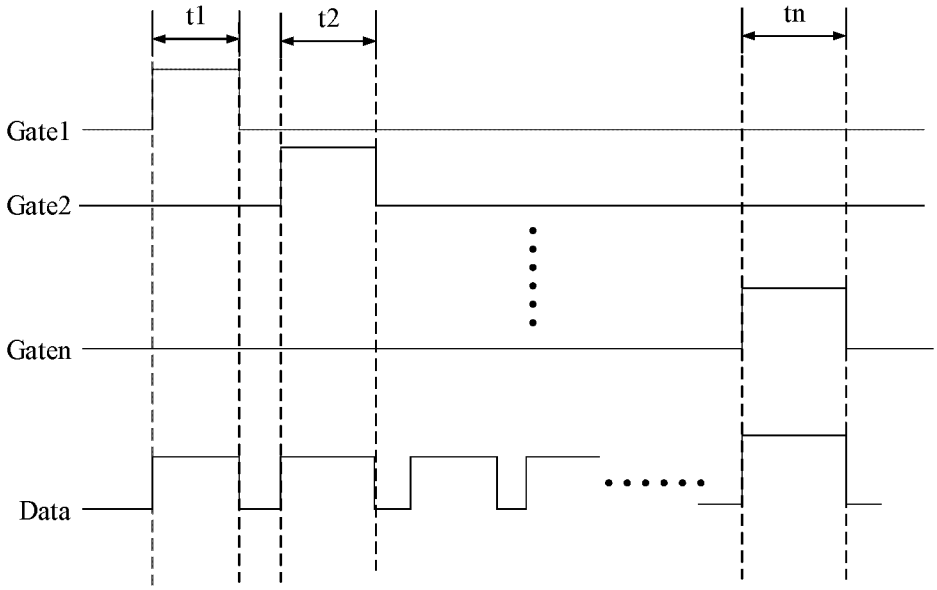
FIG. 4 is a timing diagram of data lines and gate lines of a display panel in the related art.

FIG. 4 is a timing diagram of data lines and gate lines of a display panel in the related art. As shown in FIG. 4, Gate1 is a timing diagram of a first gate line, Gate2 is a timing diagram of a second gate line, Gate n is a timing diagram of a nth gate line, and Data is a timing diagram of a certain data line. In a t1 period, the first gate line outputs the high-level signal, correspondingly, the data line outputs the high-level signal, and a first row of pixel units connected to the data line are in the data writing period. In a t2 period, a second gate line outputs the high-level signal, correspondingly, the data line outputs the high-level signal, and a second row of pixel units connected to the data line are in the data writing period. In a to period, a nth gate line outputS the high level signal, and correspondingly, the data line outputs the high level signal, and a nth row of pixel units connected to the data line are in the data writing period.

Figure 5:
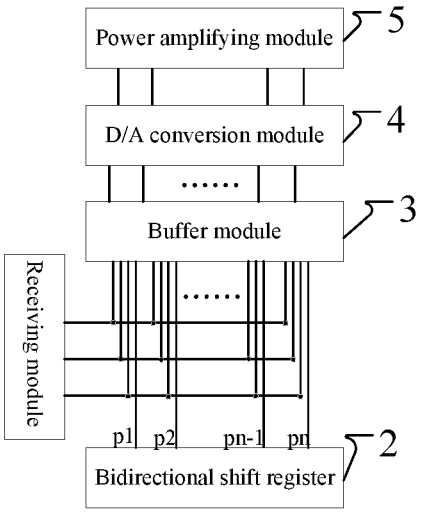
FIG. 5 is a schematic structural diagram of a source driving circuit in the related art.

In the related art, the source driving circuit is configured to input a pulse signal of a preset frequency to each data line, so as to input an analog data signal to the data signal terminal of the pixel driving circuit via each data line, and each effective pulse period of the pulse signal is in the data writing period of each row of pixel units. FIG. 5 is a schematic structural diagram of a source driving circuit in the related art. As shown in FIG. 5, the source driving circuit may include: a receiving module 1, a bidirectional shift register 2, a buffer module 3, a digital-to-analog (D/A) conversion module 4, and a power amplifying module 5. The receiving module 1 is configured to receive digital data signals. The bidirectional shift register 2 is configured to output shift signals p1, p2, . . . pn in sequence under control of a clock signal, thereby sequentially transmitting the digital data signals received by the receiving module 1 to the buffer module. The buffer module may include a data latch configured to transmit the digital data signals to the D/A conversion module simultaneously. The D/A conversion module may include a plurality of D/A converters, and is connected to a gamma voltage regulation circuit. The D/A converters can convert the digital data signals into analog data signals based on the gamma voltage input by the gamma voltage regulation circuit. The power amplifying module can include a plurality of power amplifiers, which can receive the analog data signals and improve the driving capability of the analog data signals.

Figure 6:
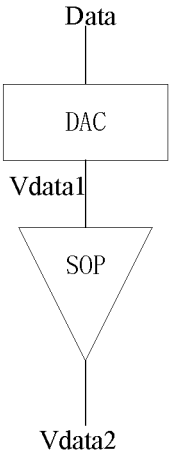
FIG. 6 is a schematic structural diagram of a part of a source driving circuit in the related art.

FIG. 6 is a schematic structural diagram of a part of a source driving circuit in the related art. FIG. 6 shows a structure of the D/A conversion module and the power amplifying module. As shown in FIG. 6, the D/A conversion module may include a digital-to-analog converter DAC, and the power amplifying module may include a power amplifier SOP. The DAC receives the digital data signal (Data), and converts the digital data signal into the analog data signal Vdata1, the Vdata1 is amplified by the power amplifier SOP and finally forms the analog data signal Vdata2.

However, as shown in FIG. 4, the timing of the analog data signal Vdata1 is the same as the timing of the signal Data in FIG. 4. The analog data signal Vdata1 should output an effective pulse in the data writing period of each row of pixel units. Moreover, the power amplifier SOP needs to perform power amplification on each effective pulse of the analog data signal Vdata1. As a result, the power consumption of the power amplifier SOP is large in a display panel with a larger resolution.

Figure 7:
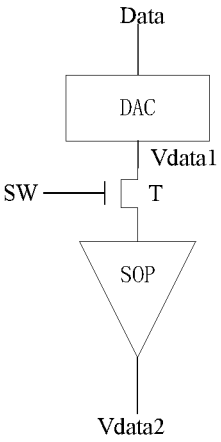
FIG. 7 is a schematic structural diagram of an exemplary implementation of a source driving circuit of the present disclosure.

In view of the above, the exemplary embodiment provides a source driving circuit. FIG. 7 is a schematic structural diagram of an exemplary embodiment of a source driving circuit of the present disclosure. As shown in FIG. 7, the source driving circuit includes a digital-to-analog converter DAC, a power amplifier SOP, and a switch unit T. The digital-to-analog converter is configured to convert the digital data signal Data into the analog data signal Vdata1. The power amplifier is configured to receive the analog data signal Vdata1, and improve the driving capability of the analog data signal Vdata1 to generate the analog data signal Vdata2. The switch unit T is connected to the digital-to-analog converter, the power amplifier, and a control signal terminal SW, and is configured to connect the digital-to-analog converter to the power amplifier in response to the signal of the control signal terminal SW. An output terminal of the power amplifier is connected to the data signal terminal in the pixel driving circuit described above, and is configured to input the analog data signal with the improved driving capability to the data signal terminal.

In this exemplary embodiment, the switch unit T may be a switching transistor. The exemplary embodiment takes the N-type switching transistor as an example for description. A first terminal of the switching transistor is connected to the digital-to-analog converter, and a second terminal of the switching transistor is connected to the power amplifier, and a control terminal of the switching transistor is connected to the control signal terminal. The source driving circuit provided by this exemplary embodiment may be disposed corresponding to the pixel driving circuit shown in FIG. 1. It should be understood that, in other exemplary embodiments, the switch unit may be the P-type transistor, and the source driving circuit may also be disposed corresponding to another pixel driving circuit. For example, the pixel driving circuit may have a 7T1C or 2T1C structure.

Figure 8:
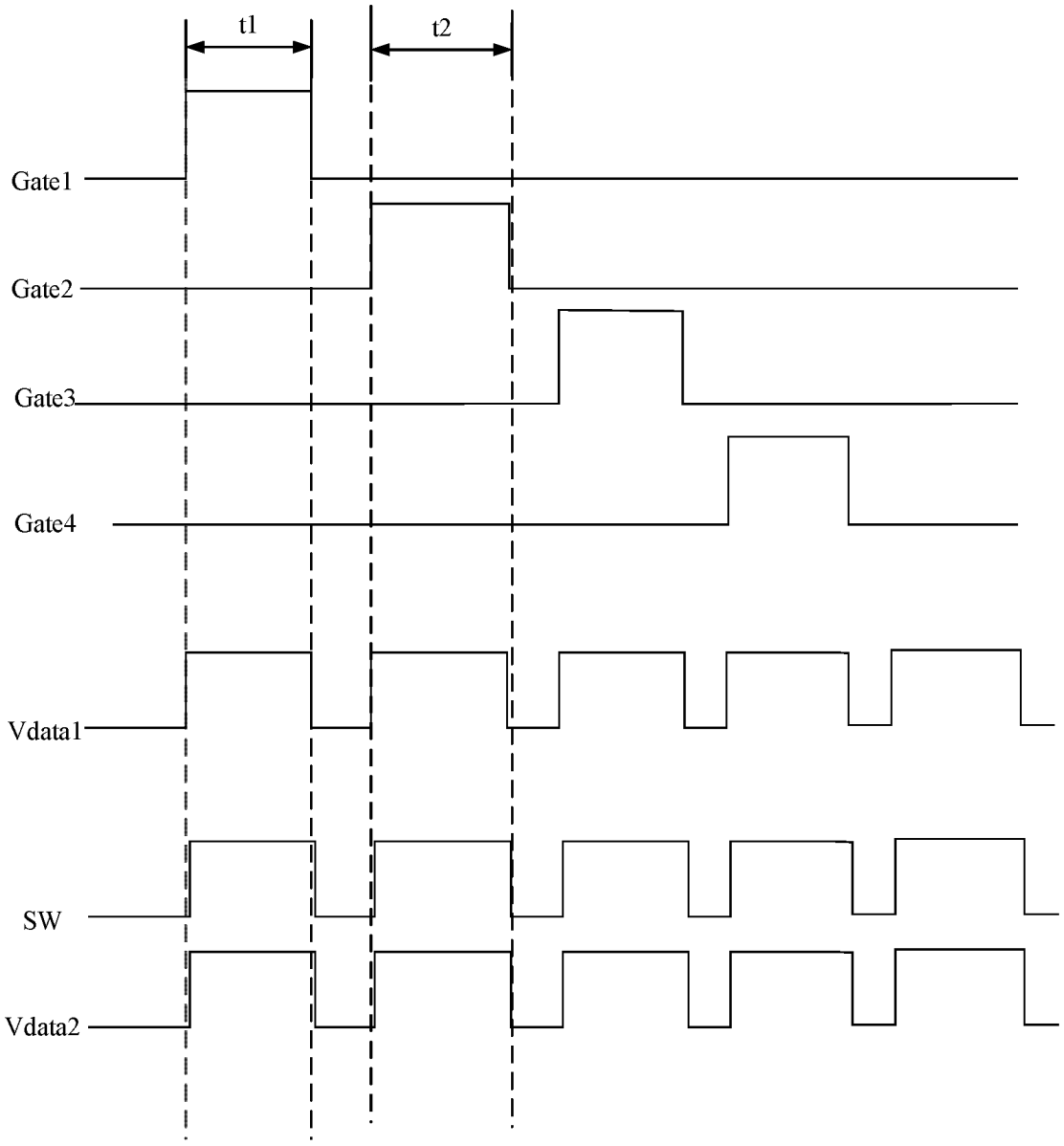
FIG. 8 is a timing diagram of various signals in another exemplary implementation of a source driving circuit of the present disclosure.

The source driving circuit provided by this exemplary embodiment may operate in different driving modes by regulating the signal of the control signal terminal SW, thereby reducing the power consumption of the power amplifier. For example, FIG. 8 is a timing diagram of various signals in another exemplary embodiment of a source driving circuit of the present disclosure. As shown in FIG. 8, Gate1 is a timing diagram of a first gate line, Gate2 is a timing diagram of a second gate line, Gate 3 is a timing diagram of a third gate line, Gate 4 is a timing diagram of a fourth gate line, Vdata1 is a timing diagram of the output terminal of the digital-to-analog converter DAC, Vdata2 is a timing diagram of the SOP output terminal of the power amplifier, and SW is a timing diagram of the control signal terminal SW. FIG. 8 shows a timing diagram of each node of the source driving circuit in one driving mode. In this driving mode, a first pulse signal is input to the control signal terminal SW, and the first pulse signal outputs an effective pulse during the data writing period of each row of pixel units (the effective pulse in this exemplary embodiment may be at the high level). For example, in the data writing period t1 of the first row of pixel units (Gate1 is at the high level), the analog data signal Vdata1 at the output terminal of the digital-to-analog converter DAC is at the high level, the signal of the control signal terminal SW is at the high level, and the switch unit T is turned on, then after amplifying the analog data signal Vdata1 of high level, the power amplifier outputs the analog data signal Vdata2 of high level. In the data writing period t2 of the second row of pixel units (Gate2 is at the high level), the analog data signal Vdata1 of the output terminal of the digital-analog converter DAC is at the high level, the signal of the control signal terminal SW is at the high level, and the switch unit T is turned on, then after amplifying the analog data signal Vdata1 of high level, the power amplifier outputs the analog data signal Vdata2 of high level. When the source driving circuit is in this driving mode, the power amplifier amplifies each effective pulse of the analog data signal Vdata1 to input a corresponding data signal to the data line during the data writing period of each row of pixel units.

Figure 9:
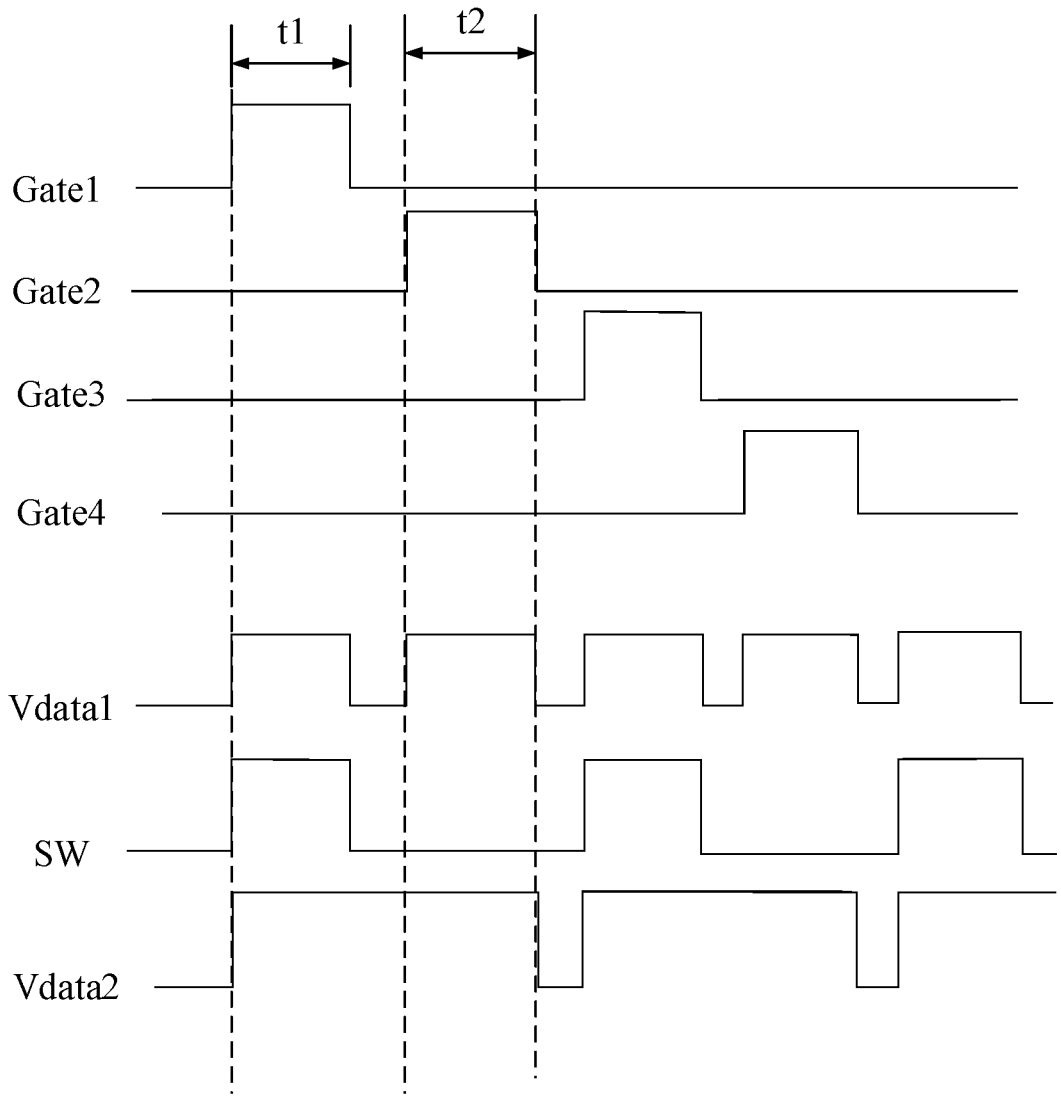
FIG. 9 is a timing diagram of various signals in another exemplary implementation of a source driving circuit of the present disclosure.

FIG. 9 is a timing diagram of various signals in another exemplary embodiment of a source driving circuit of the present disclosure, showing the timing diagram of each node of the source driving circuit in another driving mode. As shown in FIG. 9, in this driving mode, a second pulse signal is input to the control signal terminal, and the second pulse signal outputs one effective pulse during the data writing periods of every 2 rows of pixel units, and each effective pulse of the second pulse signal is in the data signal writing period of one row of pixel units. For example, as shown in FIG. 9, in the data writing period of the first row of pixel units (Gate1 is at the high level), the analog data signal Vdata1 of the output terminal of the digital-to-analog converter is at the high level, and the signal of the control signal terminal SW is at the high level, and the switch unit T is turned on, then after amplifying the analog data signal Vdata1 of high level, the power amplifier outputs the analog data signal Vdata2 of high level. In the data writing period of the second row of pixel units (Gate2 is at the high level), the analog data signal Vdata1 of the output terminal of the digital-analog converter is at the high level, the signal of the control signal terminal SW is at the low level, and the switch unit T is turned off, and the analog data signal Vdata2 output by the output terminal of the power amplifier maintains the previous high level. In this driving mode, the power amplifier performs one amplification process for every two effective pulses of the analog data signal Vdata1 to input the data signal to the data line once during the data writing periods of every two rows of pixel units. In this driving mode, every two rows of pixel units share the same analog data signal Vdata2, and the number of amplification processes performed on the analog data signal Vdata1 by the power amplifier is reduced by half. Therefore, the power consumption of the source driving circuit is reduced at the expense of partly degrading the display effect.

The source driving circuit provided by this exemplary embodiment can switch between different driving modes according to different display effect requirements and different power consumption requirements. For example, when a screen with a low display effect demand is to be displayed, e.g., when displaying an icon, the source driving circuit is switched to the driving mode shown in FIG. 9.

It should be understood that in FIG. 8, the frequency of the pulse signal of the control signal terminal is the same as the frequency of the pulse of the analog data signal Vdata1; in FIG. 9, the frequency of the pulse signal of the control signal terminal is half of the frequency of the pulse of the analog data signal Vdata1. The driving modes of the source driving circuit provided by this exemplary embodiment are not limited to the above two modes, and there may be more driving modes for the source driving circuit. The pulse signals with different frequencies can be input to the control signal terminal to achieve more driving modes. For example, the frequency of the pulse signal at the control signal terminal may be one-third, one-fourth, etc. of the frequency of the pulse of the analog data signal Vdata1. In addition, each driving mode can have more driving methods. For example, a pulse signal can be input to the control signal terminal, and the pulse signal can output an effective pulse during the data writing period of every n rows of pixel units, where n can be a positive integer greater than 1. That is, the power amplifier performs one power amplification process on every n effective pulses of the analog data signal Vdata1. As shown in FIG. 9, the first effective pulse period of the control signal terminal SW may be in the data signal writing period of the first row of pixel units. It should be understood that in other exemplary embodiments, the first effective pulse period of the control signal terminal may also be in the data signal writing period of other rows of pixel units. For example, the first effective pulse period of the control signal terminal may be in the data writing period of the second row of pixel units.

Figure 10:
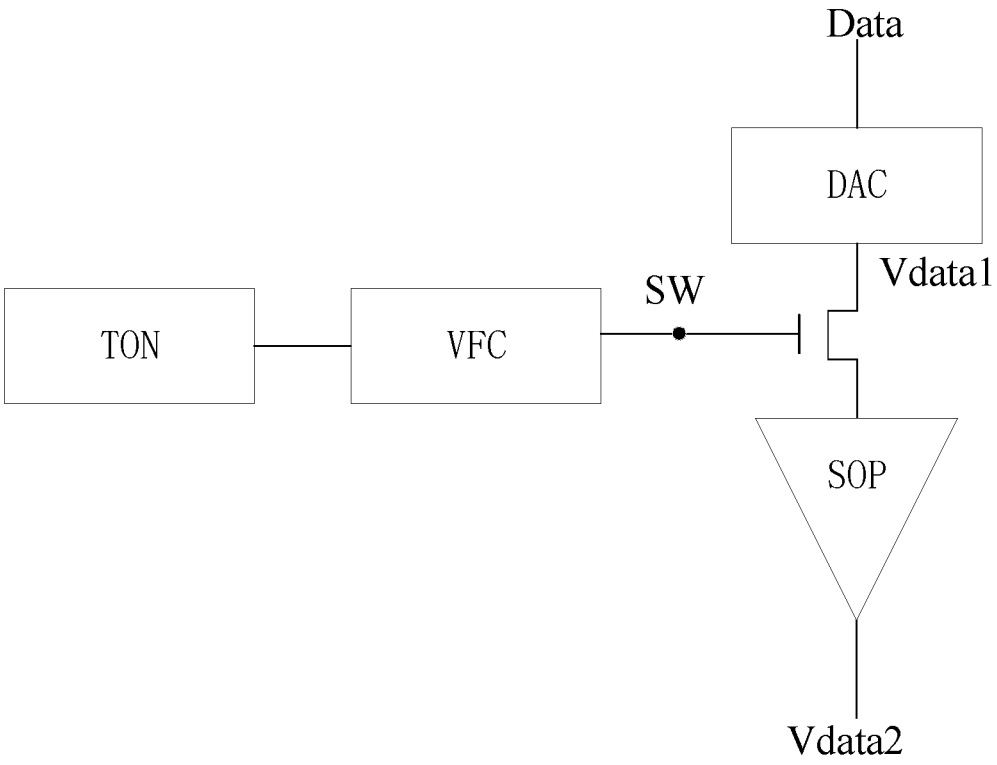
FIG. 10 is a schematic structural diagram of an exemplary implementation of a display panel of the present disclosure.

In this exemplary embodiment, FIG. 10 is a schematic structural diagram of an exemplary embodiment of a display panel of the present disclosure. As shown in FIG. 10, the display panel may include a clock control circuit TON, and the clock control circuit TON includes an output terminal for outputting a pulse signal of a first frequency. The display panel further includes a frequency converter VFC. The frequency converter VFC is connected to an output terminal of the clock control circuit and the control signal terminal SW, and is configured to send a pulse signal of a second frequency to the control signal terminal according to the pulse signal of the first frequency. Different driving modes may be realized by providing pulse signals of different frequencies to the control signal terminal SW from the frequency converter VFC.

Figure 11:
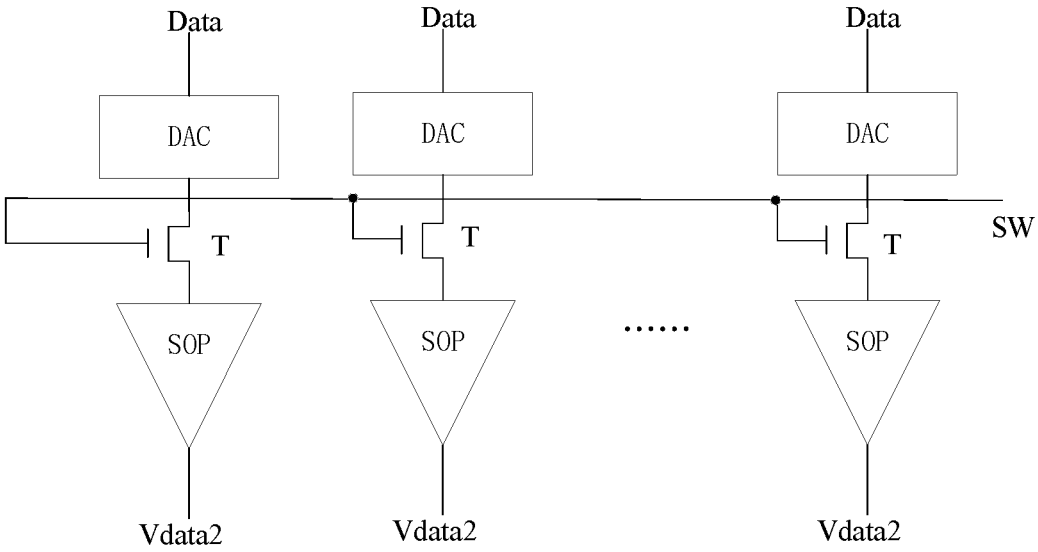
FIG. 11 is a schematic structural diagram of another exemplary implementation of a source driving circuit of the present disclosure.

FIG. 11 is a schematic structural diagram of another exemplary embodiment of a source driving circuit of the present disclosure. As shown in FIG. 11, the source driving circuit may include a plurality of digital-to-analog converters DAC, a plurality of power amplifiers SOP, and a plurality of switch units T. The plurality of digital-to-analog converters, the plurality of power amplifiers, and the plurality of switch units are disposed in the one-to-one correspondence, and the plurality of switch units are connected to the same control signal terminal SW. Each power amplifier SOP can input the data signal to one data line. Each data line connected to the source driving circuit has the pulse signal of the same frequency, that is, each column of pixel units has the same display effect.

Figure 12:
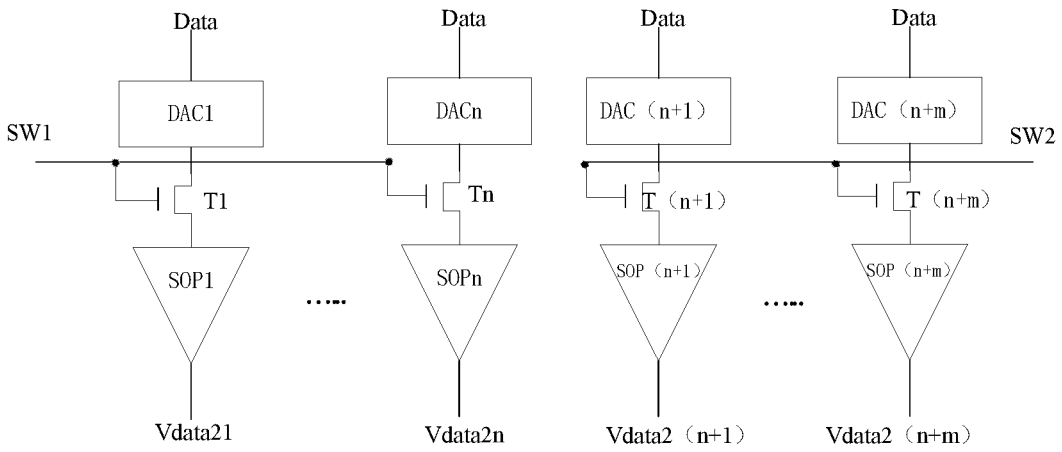
FIG. 12 is a schematic structural diagram of another exemplary implementation of a source driving circuit of the present disclosure.
Figure 13:
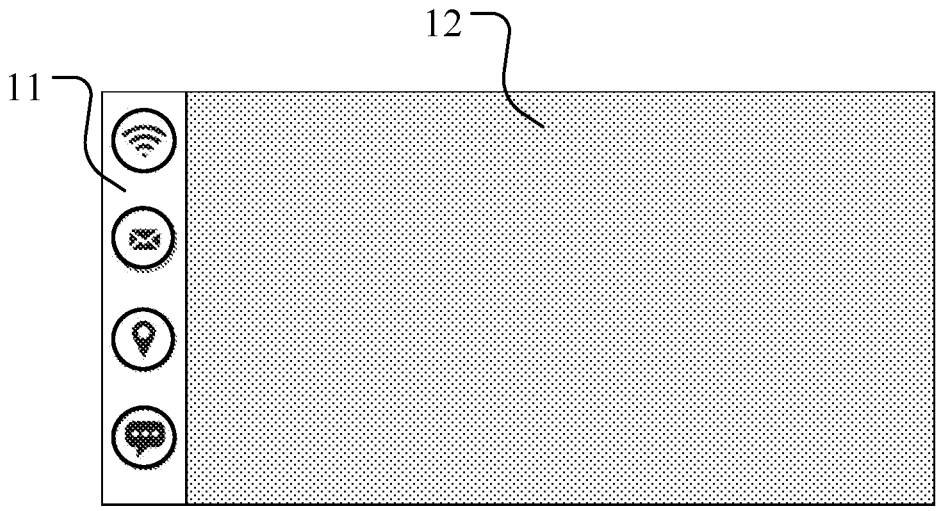
FIG. 13 is a display state diagram of an exemplary implementation of a display panel of the present disclosure.

In this exemplary embodiment, the source driving circuit may include a plurality of digital-to-analog converters DAC, a plurality of power amplifiers SOP, and a plurality of switch units T, and the plurality of digital-to-analog converters, the plurality of power amplifiers, and the plurality of switch units are disposed in the one-to-one correspondence, and at least part of the switch units are connected to different control signal terminals. For example, FIG. 12 is a schematic structural diagram of another exemplary embodiment of a source driving circuit of the present disclosure. As shown in FIG. 12, the source driving circuit may include a plurality of digital-to-analog converter DAC1-DAC (n+m), a plurality of power amplifiers SOP1-SOP(n+m), and a plurality of switch units T1-T(n+m), and the digital-to-analog converters, the power amplifiers, and the switch units are disposed in the one-to-one correspondence, where n and m are positive integers greater than or equal to 1. The plurality of switch units T1-T(n) are connected to the same control signal terminal SW1, and the plurality of switch units T(n+1)-T(n+m) are connected to the same control signal terminal SW2. The power amplifier SOP1 outputs the analog data signal Vdata21, the power amplifier SOP2 outputs the analog data signal Vdata22, and so on, the power amplifier SOPn outputs the analog data signal Vdata2*n*. In the same driving mode, the frequencies of the pulse signals on different control signal terminals can be different. For example, the timing of the control signal terminal SW2 can be the timing of SW in FIG. 8, and the timing of the control signal terminal SW1 can be the timing of SW in FIG. 9. Therefore, the frequencies of the analog data signals Vdata21-Vdata2*n* can be the frequency of Vdata2 in FIG. 9, and the frequencies of the analog data signals Vdata2(*n*+1)-Vdata2(*n*+m) can be the frequency of Vdata2 in FIG. 8. FIG. 13 is a display state diagram of an exemplary embodiment of a display panel of the present disclosure. The display panel includes a first display area 11 and a second display area 12. The output terminals of the power amplifiers SOP1-SOPn can be connected to the pixel units in the display area 11. The output terminals of the power amplifiers SOP(n+1)-SOP(n+m) can be connected to the pixel units in the display area 12. According to the above disclosure, the greater the frequency of the pulse signal output by the control signal terminal, the greater the power consumption of the power amplifier, and the better the display effect of the display panel. In the above driving mode, the display effect of the first display area 11 is poor, but the power of the power amplifier SOP1-SOPn can be reduced. The display effect of the second display area 12 is better, but the power of the power amplifier SOP(n+1)-SOP(n+m) is higher. The source driving circuit provided by the present disclosure can be used to realize different display effects in different display areas of the display panel by controlling the signal frequencies of different control signal terminals according to different display effect requirements.

It should be understood that in other exemplary embodiments, the plurality of switch units may also be connected to other numbers of control signal terminals, where each control signal terminal can output pulse signals of different frequencies. For example, each switch unit is connected to one control signal terminal, and by controlling the signal frequencies of different control signal terminals, different display effects can be realized in different display areas of the display panel. Each control signal terminal can also output pulse signals of other frequencies. For example, the frequency of the pulse signal on the control signal terminal can be a quarter of the pulse frequency of the analog data signal Vdata1. Inputting pulse signals of different frequencies to one or more control signal terminals can realize the change of the driving modes of the source driving circuit. In addition, the frequencies of pulse signals on different control signal terminals can also be the same.

This exemplary embodiment further provides a display panel driving method, used for driving the source driving circuit, and the source driving circuit is applied to the display panel. The driving method includes:

inputting pulse signals of different frequencies to at least one control signal terminal in different driving modes, where each effective pulse period of the pulse signals is in a data signal writing period of a row of pixel units.

It should be understood that, as required, a DC signal at a high level or a low level may also be input to the control signal terminal.

In an exemplary embodiment of the present disclosure, at least part of the switch units are connected to different control signal terminals, and in the same driving mode, the pulse signals of different control signal terminals have the same frequency or different frequencies.

In an exemplary embodiment of the present disclosure, the driving method includes:

inputting a first pulse signal to the at least one control signal terminal in a first driving mode, where the first pulse signal outputs an effective pulse during a data writing period of each row of pixel units;

inputting a second pulse signal to the same control signal terminals in a second driving mode, where the second pulse signal outputs an effective pulse during a data writing period of every n rows of pixel units, where n is a positive integer greater than 1.

In an exemplary embodiment of the present disclosure, a first effective pulse period of the pulse signal is in a data signal writing period of the first row of pixel units.

The driving method of the source driving circuit has been described in detail in the above content, and will not be repeated here.

This exemplary embodiment further provides a display panel including the above-mentioned source driving circuit and pixel driving circuit. The output terminal of the power amplifier is connected to the data signal terminal, and is configured to supply the analog data signal with the improved driving capability to the data signal terminal.

Figure 14:
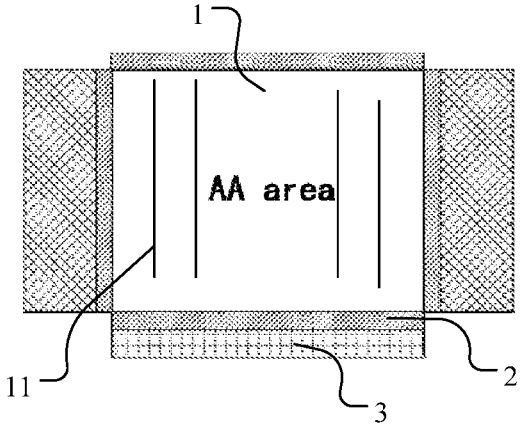
FIG. 14 is a schematic structural diagram of an exemplary implementation of a silicon-based Organic Light Emitting Diode (OLED) display panel of the present disclosure.

In an exemplary embodiment of the present disclosure, the display panel may be a silicon-based OLED display panel. FIG. 14 is a schematic structural diagram of an exemplary embodiment of a silicon-based OLED display panel of the present disclosure. As shown in FIG. 14, the silicon-based OLED display panel may include: a display area 1, a dummy area 2, a driving circuit integration area 3. The display area 1 is integrated with data lines 11. The dummy area 2 is located around the display area 1. The driving circuit integration area 3 is located on a side of the dummy area 2 away from the display area and located on a side of the display area along an extending direction of the data line, and configured to integrate the above-mentioned source driving circuit. Due to semiconductor manufacturing processes, uniformity of the semiconductor at edges is poor in the multiple semiconductors formed through multiple patterning processes. In this exemplary embodiment, the semiconductors with the same structure as that in the display area 1 may be integrated in the dummy area 2 so that the semiconductor in the display area is far away from the edge, thereby improving the uniformity of the semiconductor in the display area 1.

Other embodiments of the present disclosure will be apparent to those skilled in the art after those skilled in the art consider the specification and practice the technical solutions disclosed herein. The present application is intended to cover any variations, uses, or adaptations of the present disclosure, which are in accordance with the general principles of the present disclosure and include common general knowledge or conventional technical means in the art that are not disclosed in the present disclosure. The specification and embodiments are illustrative, and the real scope and spirit of the present disclosure is defined by the appended claims.

What is claimed is:

1. A display panel, comprising:

a source driving circuit, comprising:

a digital-to-analog converter configured to convert a digital data signal into an analog data signal;

a power amplifier configured to receive the analog data signal and improve a driving capability of the analog data signal; and a switch unit connected to the digital-to-analog converter, the power amplifier, and a control signal terminal, and configured to connect the digital-to-analog converter to the power amplifier in response to a signal of the control signal terminal; and a pixel driving circuit, comprising;

a data writing transistor, a gate of the data writing transistor being connected to a control terminal, a first electrode of the data writing transistor being connected to a data signal terminal, a second electrode of the data writing transistor being connected to a first node;

a driving transistor comprising an active layer located inside a base substrate, a control terminal of the driving transistor being connected to the first node, and a first electrode of the driving transistor being connected to a second node;

a light-emitting unit connected between a second electrode of the driving transistor and a second power supply terminal; and a capacitor electrically connected to the first node;

wherein an output terminal of the power amplifier is connected to the data signal terminal to supply the analog data signal with an improved driving capability to the data signal terminal and wherein the display panel further comprises a clock control circuit having an output terminal for outputting a pulse signal of a first frequency, and the display panel further comprises:

a frequency converter, connected to the output terminal of the clock control circuit and the control signal terminal, and configured to send a pulse signal of a second frequency to the control signal terminal based on the pulse signal of the first frequency.

2. The display panel of claim 1, wherein the control terminal of the data writing transistor comprises a first control terminal and a second control terminal, and the data writing transistor comprises:

a first P-type transistor, a control terminal of the first P-type transistor being connected to the second control terminal, a first terminal of the first P-type transistor being connected to the data signal terminal, and a second terminal of the first P-type transistor being connected to the first node; and a second N-type transistor, a control terminal of the second N-type transistor being connected to the first control terminal, a first terminal of the second N-type transistor being connected to the data signal terminal, and a second terminal of the second N-type transistor being connected to the first node.

3. The display panel of claim 1, wherein the switch unit comprises: a switching transistor, a first terminal of the switching transistor being connected to the digital-to-analog converter, a second terminal of the switching transistor being connected to the power amplifier, and a control terminal of the switching transistor being connected to the control signal terminal.

4. The display panel of claim 3, wherein the switching transistor is a P-type transistor or an N-type transistor.

5. The display panel of claim 1, wherein the source driving circuit comprises a plurality of digital-to-analog converters, a plurality of power amplifiers, and a plurality of switch units, and the plurality of digital-to-analog converters, the plurality of power amplifiers and the plurality of switch units are disposed in a one-to-one correspondence.

6. The display panel of claim 5, wherein the plurality of switch units are connected to the same control signal terminal.

7. The display panel of claim 5, wherein at least part of the switch units are connected to different control signal terminals.

8. The display panel of claim 1, wherein the display panel is a silicon-based OLED display panel.

9. The display panel of claim 8, wherein the silicon-based OLED display panel comprises:

a display area integrated with data lines;

a dummy area located around the display area; and a driving circuit integration area, located on a side of the dummy area away from the display area and located on a side of the display area along an extending direction of the data line, and configured to incorporate the source driving circuit.

10. A display panel driving method, comprising:

providing a display panel that comprises a source driving circuit and a pixel driving circuit, wherein the source driving circuit comprises:

a digital-to-analog converter configured to convert a digital data signal into an analog data signal;

a power amplifier configured to receive the analog data signal and improve a driving capability of the analog data signal; and a switch unit connected to the digital-to-analog converter, the power amplifier, and a control signal terminal, and configured to connect the digital-to-analog converter to the power amplifier in response to a signal of the control signal terminal;

wherein the pixel driving circuit comprises:

a data writing transistor, a gate of the data writing transistor being connected to a control terminal, a first electrode of the data writing transistor being connected to a data signal terminal, a second electrode of the data writing transistor being connected to a first node;

a driving transistor comprising an active layer located inside a base substrate, a control terminal of the driving transistor being connected to the first node, and a first electrode of the driving transistor being connected to a second node;

a light-emitting unit connected between a second electrode of the driving transistor and a second power supply terminal; and a capacitor electrically connected to the first node;

wherein an output terminal of the power amplifier is connected to the data signal terminal to supply the analog data signal with an improved driving capability to the data signal terminal;

inputting pulse signals of different frequencies to at least one control signal terminal in different driving modes;

wherein each effective pulse period of the pulse signals is in a data signal writing period of a row of pixel units.

11. The display panel driving method of claim 10, wherein at least part of the switch units are connected to different control signal terminals, and in a same driving mode, the pulse signals of the different control signal terminals have a same frequency.

12. The display panel driving method according to claim 10, wherein at least part of the switch units are connected to different control signal terminals, and in a same driving mode, the pulse signals of the different control signal terminals have different frequencies.

13. The display panel driving method of claim 10, wherein the driving method comprises:

inputting a first pulse signal to at least one control signal terminal in a first driving mode, wherein the first pulse signal outputs one effective pulse during a data writing period of each row of pixel units; and inputting a second pulse signal to the control signal terminal, which is input with the first driving mode in the first mode, in a second driving mode, wherein the second pulse signal outputs one effective pulse during a data writing period of every n rows of pixel units, where n is a positive integer greater than 1.

14. The display panel driving method of claim 10, wherein a first effective pulse period of the pulse signal is in a data signal writing period of a first row of pixel units.

15. The display panel driving method of claim 10, wherein the switch unit comprises: a switching transistor, a first terminal of the switching transistor being connected to the digital-to-analog converter, a second terminal of the switching transistor being connected to the power amplifier, and a control terminal of the switching transistor being connected to the control signal terminal.

16. The display panel driving method of claim 10, wherein:

the display panel further comprises a clock control circuit having an output terminal for outputting a pulse signal of a first frequency; and the display panel further comprises a frequency converter connected to the output terminal of the clock control circuit and the control signal terminal, and configured to send a pulse signal of a second frequency to the control signal terminal based on the pulse signal of the first frequency.

17. The display panel driving method of claim 10, wherein the source driving circuit comprises a plurality of digital-to-analog converters, a plurality of power amplifiers, and a plurality of switch units, and the plurality of digital-to-analog converters, the plurality of power amplifiers and the plurality of switch units are disposed in a one-to-one correspondence.

18. The display panel driving method of claim 17, wherein the plurality of switch units are connected to the same control signal terminal.

19. The display panel driving method of claim 17, wherein at least part of the switch units are connected to different control signal terminals.

* * * * *